US008805695B2

(12) United States Patent
Liu et al.

(10) Patent No.: US 8,805,695 B2
(45) Date of Patent: Aug. 12, 2014

(54) BANDWIDTH EXPANSION METHOD AND APPARATUS

(71) Applicant: Huawei Technologies Co., Ltd., Guangdong (CN)

(72) Inventors: Zexin Liu, Beijing (CN); Lei Miao, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 13/947,778

(22) Filed: Jul. 22, 2013

(65) Prior Publication Data

US 2013/0317831 A1 Nov. 28, 2013

Related U.S. Application Data

(63) Continuation of application No. PCT/CN2011/080443, filed on Sep. 30, 2011.

(30) Foreign Application Priority Data

Jan. 24, 2011 (CN) ..... 2011 1 0025741

(51) Int. Cl.
*G10L 19/00* (2013.01)

(52) U.S. Cl.
USPC ..... 704/500; 704/219; 704/223; 704/258; 704/265; 370/468; 370/472; 375/250; 375/262

(58) Field of Classification Search
USPC ..... 704/500
See application file for complete search history.

(56) References Cited

U.S. PATENT DOCUMENTS

| | | | | |
|---|---|---|---|---|
| 6,226,616 | B1 * | 5/2001 | You et al. | 704/500 |
| 6,704,711 | B2 * | 3/2004 | Gustafsson et al. | 704/258 |
| 6,895,375 | B2 | 5/2005 | Malah et al. | |
| 7,181,402 | B2 * | 2/2007 | Jax et al. | 704/500 |
| 7,461,003 | B1 * | 12/2008 | Tanrikulu | 704/500 |
| 7,546,237 | B2 * | 6/2009 | Nongpiur et al. | 704/209 |
| 7,734,462 | B2 * | 6/2010 | Kabal et al. | 704/201 |

(Continued)

FOREIGN PATENT DOCUMENTS

| | | |
|---|---|---|
| CN | 1416563 A | 5/2003 |
| CN | 1503968 A | 6/2004 |

(Continued)

OTHER PUBLICATIONS

International Search Report dated Feb. 2, 2012 in connection with International Patent Application No. PCT/CN2011/080443.

*Primary Examiner* — Michael Colucci

(57) ABSTRACT

A bandwidth expansion method and apparatus are disclosed, where the method includes: estimating a bandwidth of at least one decoded frame of a whole-band signal, so as to obtain an estimated bandwidth, where the estimated bandwidth corresponds to a whole-band signal that a decoded lower-band signal needs to be extended into; performing first predictive decoding on a part of the lower-band signal in a band above an effective bandwidth of the lower-band signal and below the estimated bandwidth, so as to obtain the part of the lower-band signal above the effective bandwidth of the lower-band signal and below the estimated bandwidth; and performing second predictive decoding on a part of the lower-band signal in a band above the estimated bandwidth, so as to obtain the part of the lower-band signal above the estimated bandwidth.

18 Claims, 12 Drawing Sheets

(56) References Cited

U.S. PATENT DOCUMENTS

| | | | | |
|---|---|---|---|---|
| 7,756,711 | B2 * | 7/2010 | Oshikiri | 704/500 |
| 2002/0193988 | A1 | 12/2002 | Chennoukh et al. | |
| 2003/0093279 | A1 * | 5/2003 | Malah et al. | 704/265 |
| 2004/0111257 | A1 * | 6/2004 | Sung et al. | 704/219 |
| 2005/0004793 | A1 * | 1/2005 | Ojala et al. | 704/219 |
| 2005/0267741 | A1 | 12/2005 | Laaksonen et al. | |
| 2006/0190245 | A1 * | 8/2006 | Iser et al. | 704/219 |
| 2007/0005351 | A1 * | 1/2007 | Sathyendra et al. | 704/223 |
| 2007/0124140 | A1 * | 5/2007 | Iser et al. | 704/223 |
| 2008/0126081 | A1 * | 5/2008 | Geiser et al. | 704/201 |
| 2010/0070272 | A1 * | 3/2010 | Lee et al. | 704/219 |
| 2010/0125455 | A1 | 5/2010 | Wang et al. | |
| 2010/0198588 | A1 * | 8/2010 | Sudo et al. | 704/205 |
| 2010/0332221 | A1 * | 12/2010 | Yamanashi et al. | 704/207 |
| 2011/0054885 | A1 * | 3/2011 | Nagel et al. | 704/203 |
| 2011/0099004 | A1 * | 4/2011 | Krishnan et al. | 704/206 |
| 2011/0202353 | A1 * | 8/2011 | Neuendorf et al. | 704/500 |

FOREIGN PATENT DOCUMENTS

| | | | |
|---|---|---|---|
| CN | 1985304 | A | 6/2007 |
| CN | 2927247 | Y | 7/2007 |
| CN | 101185125 | A | 5/2008 |

* cited by examiner

BANDWIDTH EXPANSION METHOD AND APPARATUS

CROSS-REFERENCE TO RELATED APPLICATION

This application is a continuation of International Application No. PCT/CN2011/080443, filed on Sep. 30, 2011, which claims priority to Chinese Patent Application No. 201110025741.1, filed on Jan. 24, 2011, both of which are hereby incorporated by reference in their entireties.

TECHNICAL FIELD

The present invention relates to the field of communications technologies, and in particular, to a bandwidth expansion method and apparatus.

BACKGROUND

In network communication and when a network state is good, a network may not truncate a data stream (for example, a voice signal stream) sent by a sending end but directly send it to a receiving end, and the receiving end may obtain a whole-band signal through decoding according to the data stream sent by the network and output the signal to a user for listening. When the network state is poor, the network may truncate the data stream sent by the sending end in different lengths, and the receiving end may obtain a lower-band signal or a whole-band signal through decoding according to the truncated data stream sent by the network and output the signal to the user for listening. Switching between the lower-band signal and the whole-band signal exists at signal outputting at the receiving end, and such switching between signals of different bandwidths usually leads to bad audio influence on the user, and reduces user experience. Therefore, for the receiving end, the lower-band signal after decoding needs to be further expanded into the whole-band signal, so as to reduce an abrupt change of the bandwidth, reduce the audio influence on the user, and improve the user experience.

In the prior art, when a lower-band signal is expanded into a whole-band signal, usually a default bandwidth is used as an estimated bandwidth corresponding to the whole-band signal that the lower-band signal is expanded into, which brings audio influence on the user when the lower-band signal is expanded into the whole-band signal, and reduces the user experience.

SUMMARY

According to the foregoing defects, embodiments of the present invention provide a bandwidth expansion method and apparatus, so as to reduce an audio influence on a user, and improve user experience.

An embodiment of the present invention provides a bandwidth expansion method, including:

estimating a bandwidth of at least one decoded frame of a whole-band signal, so as to obtain an estimated bandwidth; where the estimated bandwidth corresponds to a whole-band signal that a decoded lower-band signal needs to be extended into;

performing first predictive decoding on a part of the lower-band signal in a band above an effective bandwidth of the lower-band signal and below the estimated bandwidth, so as to obtain the part of the lower-band signal above the effective bandwidth of the lower-band signal and below the estimated bandwidth; and performing second predictive decoding on a part of the lower-band signal in a band above the estimated bandwidth, so as to obtain the part of the lower-band signal above the estimated bandwidth.

Accordingly, an embodiment of the present invention provides a bandwidth expansion apparatus, including an estimation unit and a predictive decoding unit;

the estimation unit is configured to estimate a bandwidth of at least one decoded frame of a whole-band signal, so as to obtain an estimated bandwidth; where the estimated bandwidth corresponds to a whole-band signal that a decoded lower-band signal needs to be extended into; and the predictive decoding unit includes:

a first predictive decoding sub-unit, configured to perform first predictive decoding on a part of the lower-band signal in a band above an effective bandwidth of the lower-band signal and below the estimated bandwidth, so as to obtain the part of the lower-band signal above the effective bandwidth of the lower-band signal and below the estimated bandwidth; and a second predictive decoding sub-unit, configured to perform second predictive decoding on a part of the lower-band signal in a band above the estimated bandwidth, so as to obtain the part of the lower-band signal above the estimated bandwidth.

In the embodiments of the present invention, a bandwidth of a decoded whole-band signal is estimated, so as to obtain an estimated bandwidth. The estimated bandwidth of the whole-band signal is used as an estimated bandwidth of a current frame of a lower-band signal, and when the current frame of the lower-band signal is expanded into the whole-band signal, different predictive decoding methods are adopted for a part of the signal in a band above the estimated bandwidth and a part of the signal in a band below the estimated bandwidth. The energy or the amplitude of the band above the estimated bandwidth is smaller than the energy or the amplitude of the band below the estimated bandwidth. Compared with a manner of using a default bandwidth, in the embodiment of the present invention, a bad audio effect introduced because of prediction of an additional signal component is reduced in the band above the estimated bandwidth, thereby reducing an audio influence on a user, and improving the user experience.

BRIEF DESCRIPTION OF DRAWINGS

To describe the technical solutions in the embodiments of the present invention more clearly, the following briefly introduces the accompanying drawings required for describing the embodiments of the present invention. Apparently, the accompanying drawings in the following description show merely some embodiments of the present invention, and persons or ordinary skill in the art may still derive other drawings from these accompanying drawings without creative efforts.

DETAILED DESCRIPTION

The following clearly and describes the technical solutions in the embodiments of the present invention with reference to the accompanying drawings in the embodiments of the present invention. Apparently, the described embodiments are merely a part rather than all of the embodiments of the present invention. All other embodiments obtained by persons of ordinary skill in the art based on the embodiment of the present invention without creative efforts shall fall within the protection scope of the present invention.

In a digital signal processing field, audio decoders and video decoders are widely used in various electronic devices, for example: a mobile phone, a wireless apparatus, a personal digital assistant (PDA), a hand-held computer or a portable computer, a GPS receiver/navigator, a camera, an audio/video player, a video camera, a video recorder, a monitoring device, and the like. Electronic devices of this type usually include a speech and audio codec, and the speech and audio codec may be directly implemented through a digital circuit or a chip such as a DSP (digital signal processor), or be implemented by a software code driving a processor to execute a procedure in the software code.

For example, in a speech and audio codec, a coding end transforms, through MDCT transformation, a time domain signal into a frequency domain signal, quantizes some coefficients or parameters in the frequency domain through a quantizer, and transfers the quantized coefficients or parameters to a decoding end in a form of a code stream. The decoding end restores the quantized coefficients or parameters by decoding the code stream, and transforms, through inverse MDCT transformation, the frequency domain signal into the time domain signal for outputting. When signal switching occurs and a lower-band signal is expanded into a whole-band signal, as there is no parameter for guiding, and a bandwidth corresponding to the whole-band signal that the lower-band signal is expanded into cannot be learned, only a default bandwidth is used as the bandwidth corresponding to the whole-band signal obtained through expansion, which may introduce a bad audio influence. Therefore, it is necessary to estimate a bandwidth corresponding to the whole-band signal that lower-band signal is expanded into, and then expand the lower-band signal according to the estimated bandwidth, thereby avoiding introduction of a bad audio influence when the lower-band signal is expanded into the whole-band signal. Specifically, estimation may be performed according to a bandwidth of a previous decoded frame of a whole-band signal, and the obtained estimated bandwidth is used as a bandwidth corresponding to the whole-band signal that a current frame of lower-band signal is expanded into.

Embodiments of the present invention provide a bandwidth expansion method and apparatus, so as to reduce an audio influence on a user, and improve user experience. The following is a detailed description.

Figure 1:
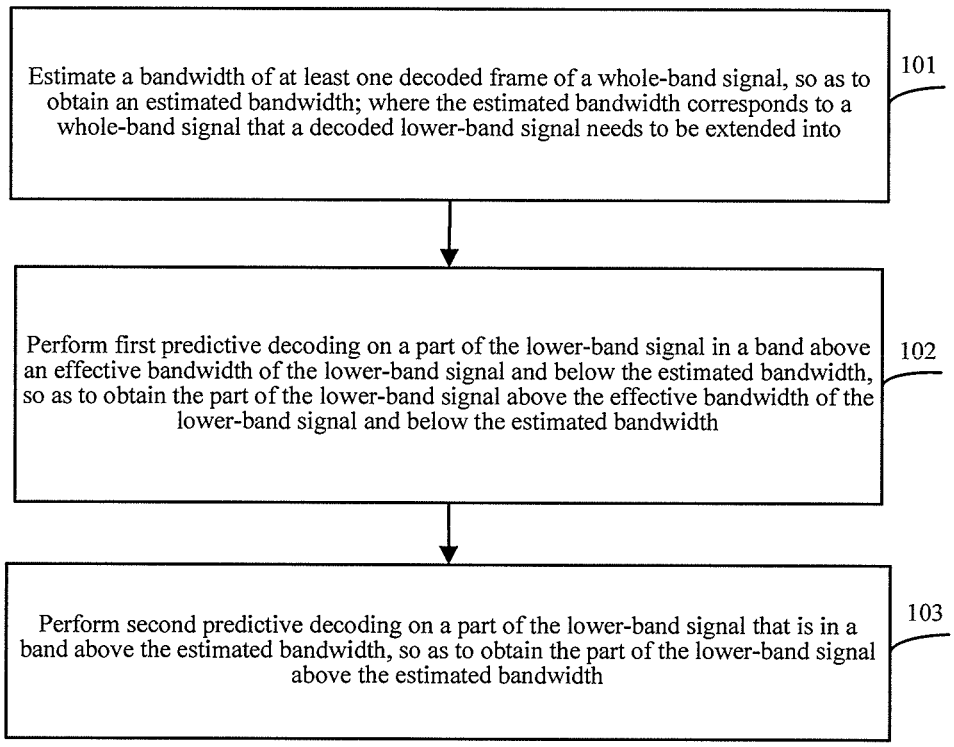
FIG. 1 is a schematic flow chart of a bandwidth expansion method according to an embodiment of the present invention.

Referring to FIG. 1, FIG. 1 is a schematic flow chart of a bandwidth expansion method according to an embodiment of the present invention. As shown in FIG. 1, the method may include the following steps:

101: Estimate a bandwidth of at least one decoded frame of a whole-band signal, so as to obtain an estimated bandwidth; where the estimated bandwidth corresponds to a whole-band signal that a decoded lower-band signal needs to be extended into.

The lower-band signal is a decoded signal whose effective bandwidth is smaller than an effective bandwidth of the decoded whole-band signal.

In network communication, the lower-band signal and the whole-band signal are two relative concepts, and used to refer to two signal having different total bandwidths. An ultra-whole-band signal and a whole-band signal may be referred to as whole-band signal, and a whole-band and lower-band may be referred to as lower-band signal.

In the embodiments of the present invention, multiple different methods may be used to estimate a bandwidth of a decoded whole-band signal, so as to obtain an estimated bandwidth, which is described with reference to specific embodiments subsequently in the embodiments of the present invention.

102: Perform first predictive decoding on a part of the lower-band signal in a band above an effective bandwidth of the lower-band signal and below the estimated bandwidth, so as to obtain the part of the lower-band signal above the effective bandwidth of the lower-band signal and below the estimated bandwidth.

103: Perform second predictive decoding on a part of the lower-band signal that is in a band above the estimated bandwidth, so as to obtain the part of the lower-band signal above the estimated bandwidth.

Figure 2A:
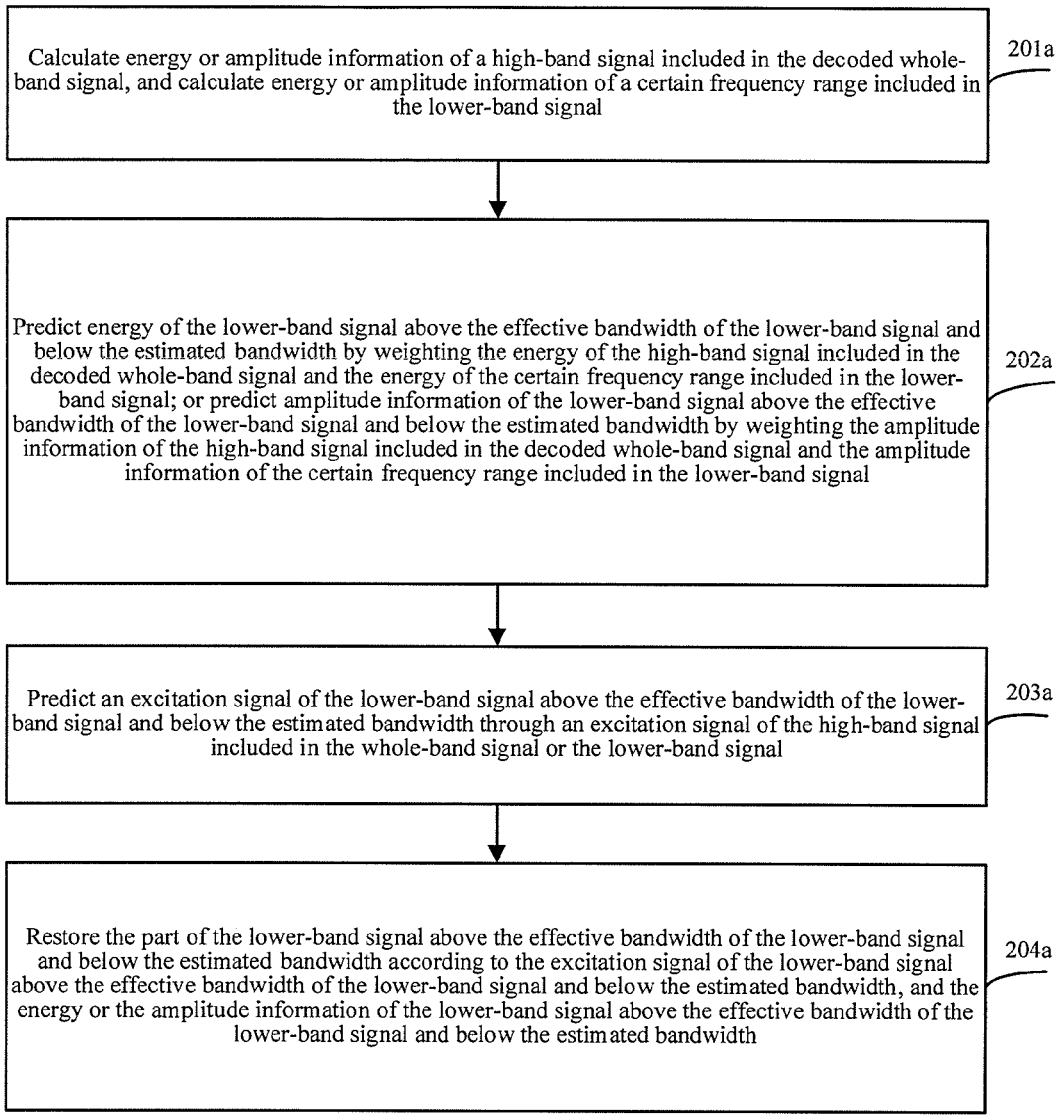
FIG. 2*a* and FIG. 2*b* are schematic flow chart of a method for obtaining a signal below an estimated bandwidth in the bandwidth expansion method shown in FIG. 1.

As an optional implementation manner, for a specific implementation process of step 102 in the foregoing, reference may be made to the method shown in FIG. 2*a*, which may include the following steps:

201*a*: Calculate energy or amplitude information of a high-band signal included in the decoded whole-band signal, and calculate energy or amplitude information of a certain frequency range included in the lower-band signal.

As an optional implementation manner, the high-band signal included in the decoded whole-band signal and the certain frequency range included in the lower-band signal each may be divided into a same number of bands, and energy or amplitude information of each band is calculated, so as to obtain the energy or the amplitude information of the high-band signal included in the decoded whole-band signal, and obtain the energy or the amplitude information of the certain frequency range included in the lower-band signal in the embodiments of the present invention.

202*a*: Predict energy of the lower-band signal above the effective bandwidth of the lower-band signal and below the estimated bandwidth by weighting the energy of the high-band signal included in the decoded whole-band signal and the energy of the certain frequency range included in the lower-band signal; or predict amplitude information of the lower-band signal above the effective bandwidth of the lower-band signal and below the estimated bandwidth by weighting the amplitude information of the high-band signal included in the decoded whole-band signal and the amplitude information of the certain frequency range included in the lower-band signal.

For example, it is assumed that the energy or the amplitude information of the high-band signal included in the foregoing decoded whole-band signal is x, and the energy or the amplitude information of the certain frequency range included in the lower-band signal is y, a manner for weighting x and y may be:

$$z=A*x+B*y, \text{ where}$$

z represents a weighted value of x and y, A represents a weighting factor corresponding to x, B represents a weighting factor corresponding to y, and A and B satisfy: 0<=A, B<=1; and A+B=1.

203*a*: Predict an excitation signal of the lower-band signal above the effective bandwidth of the lower-band signal and below the estimated bandwidth through an excitation signal of the high-band signal included in the whole-band signal or the lower-band signal.

204*a*: Restore the part of the lower-band signal above the effective bandwidth of the lower-band signal and below the estimated bandwidth according to the excitation signal of the lower-band signal above the effective bandwidth of the lower-band signal and below the estimated bandwidth, and the energy or the amplitude information of the lower-band signal above the effective bandwidth of the lower-band signal and below the estimated bandwidth.

Figure 2B:
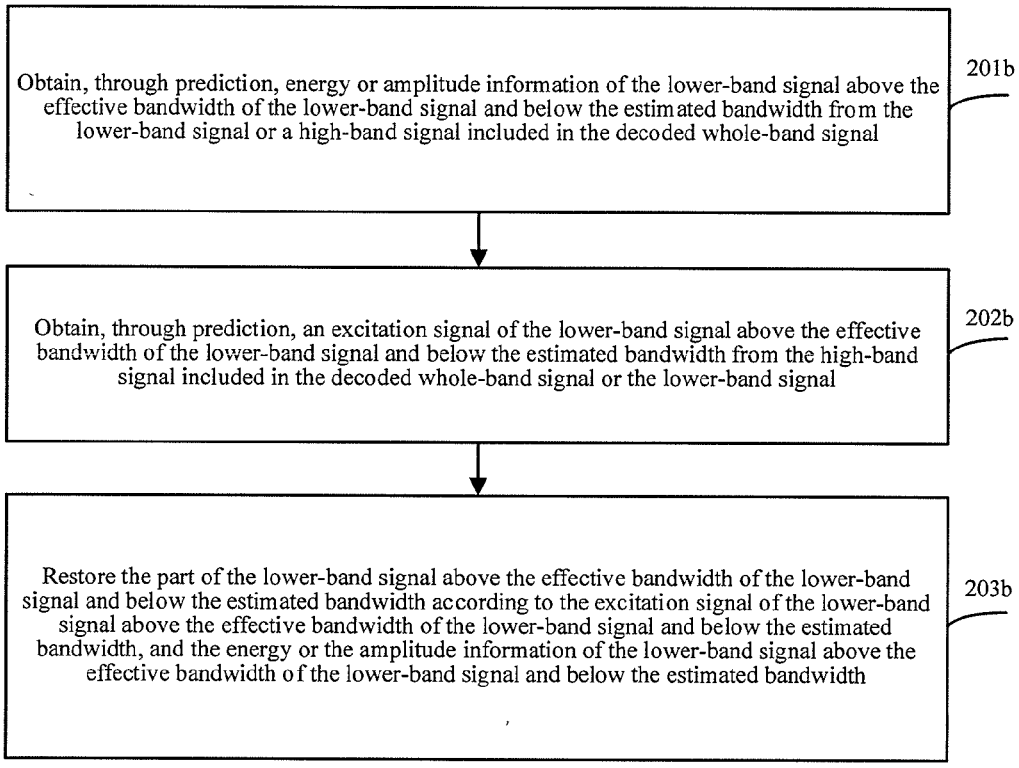

As an optional implementation manner, for a specific implementation process of step 102 in the foregoing, reference may be made to the method shown in FIG. 2*b*, which may include the following steps:

201*b*: Obtain, through prediction, energy or amplitude information of the lower-band signal above the effective bandwidth of the lower-band signal and below the estimated bandwidth from the lower-band signal or a high-band signal included in the decoded whole-band signal.

202*b*: Obtain, through prediction, an excitation signal of the lower-band signal above the effective bandwidth of the lower-band signal and below the estimated bandwidth from the high-band signal included in the decoded whole-band signal or the lower-band signal.

In the embodiment of the present invention, the excitation signal of the lower-band signal above the effective bandwidth of the lower-band signal and below the estimated bandwidth may also be obtained in other manners, which is not limited in the embodiment of the present invention.

203*b*: Restore the part of the lower-band signal above the effective bandwidth of the lower-band signal and below the estimated bandwidth according to the excitation signal of the lower-band signal above the effective bandwidth of the lower-band signal and below the estimated bandwidth, and the energy or the amplitude information of the lower-band signal above the effective bandwidth of the lower-band signal and below the estimated bandwidth.

The foregoing energy or amplitude information may be a frequency domain envelope.

Figure 3:
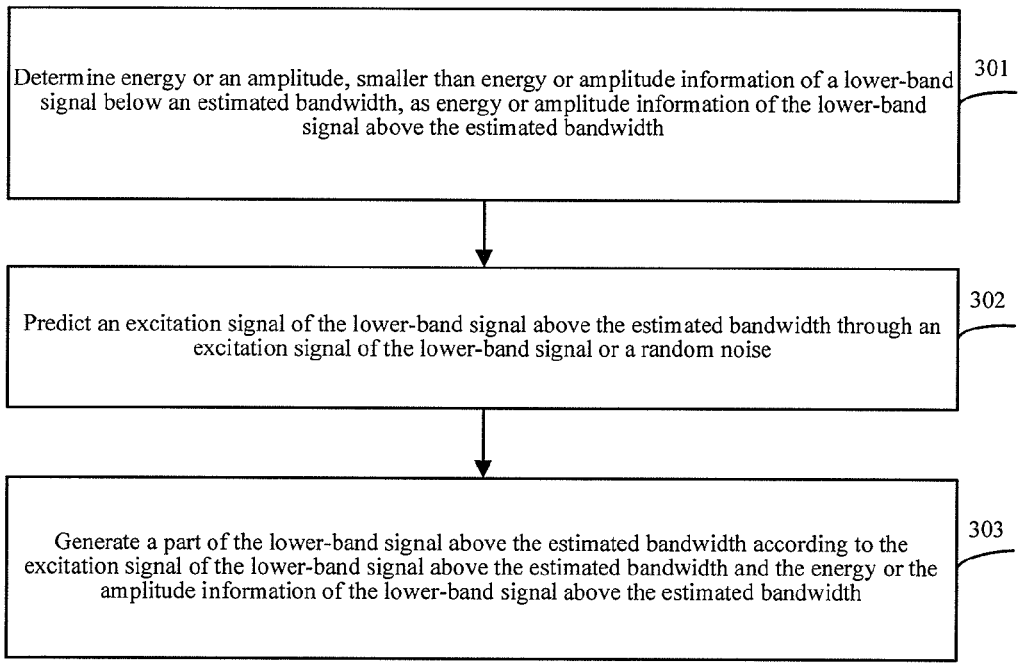
FIG. 3 is a schematic flow chart of a method for obtaining a signal above an estimated bandwidth in the bandwidth expansion method shown in FIG. 1.

As an optional implementation manner, for a specific implementation process of step 103 in the foregoing, reference may be made to the method shown in FIG. 3, which may include the following steps:

301: Determine energy or an amplitude, smaller than energy or amplitude information of the lower-band signal below the estimated bandwidth, as energy or amplitude information of the lower-band signal above the estimated bandwidth.

For example, energy or amplitude information of the decoded whole-band signal above the estimated bandwidth may be used as the energy or the amplitude information of the lower-band signal above the estimated bandwidth. Specifically, energy or amplitude information of the one decoded frame of the whole-band signal above the estimated bandwidth may be used as the energy or the amplitude information of the lower-band signal above the estimated bandwidth, or energy or amplitude information of the multiple frames of the decoded whole-band signal above the estimated bandwidth is weighted to be used as the energy or the amplitude information of the lower-band signal above the estimated bandwidth, as long as the weighted energy or amplitude information is smaller than the energy or the amplitude of the energy or the amplitude information of the lower-band signal below the estimated bandwidth. Alternatively, in the embodiments of the present invention, preset energy or amplitude information may be used as the energy or the amplitude information of the lower-band signal above the estimated bandwidth, where the preset energy or amplitude is smaller than the energy or the amplitude of the energy or the amplitude information of the lower-band signal below the estimated bandwidth. Alternatively, in the embodiments of the present invention, the energy or the amplitude information of the lower-band signal below the estimated bandwidth may be attenuated to be used as the energy or the amplitude information of the lower-band signal above the estimated bandwidth.

302: Predict an excitation signal of the lower-band signal above the estimated bandwidth through an excitation signal of the lower-band signal or a random noise.

303: Restore the part of the lower-band signal above the estimated bandwidth according to the excitation signal of the lower-band signal above the estimated bandwidth and the energy or the amplitude information of the lower-band signal above the estimated bandwidth.

In the embodiments of the present invention, a bandwidth of a decoded whole-band signal is estimated, so as to obtain the estimated bandwidth. The estimated bandwidth of the whole-band signal is used as an estimated bandwidth of a current frame of a lower-band signal, and when the current frame of the lower-band signal is expanded into a whole-band signal, different predictive decoding methods are adopted for a part of the signal in a band above the estimated bandwidth and a part of the signal in a band below the estimated bandwidth. When predictive decoding is performed on the part of the signal in a band above the estimated bandwidth, energy or an amplitude smaller than energy or amplitude information of the lower-band signal below the estimated bandwidth is determined to be used as energy or amplitude information of the lower-band signal above the estimated bandwidth, and then, the part of the lower-band signal above the estimated bandwidth is restored according to an excitation signal of the lower-band signal above the estimated bandwidth and the energy or the amplitude information of the lower-band signal above the estimated bandwidth. Compared with the manner of using a default bandwidth, in the embodiment of the present invention, a bad audio effect introduced because of prediction of an additional signal component is reduced in the band above the estimated bandwidth, thereby reducing an audio influence on the user, and improving the user experience.

In the embodiments of the present invention, the estimating the bandwidth of the decoded whole-band signal, so as to obtain the estimated bandwidth in step 101 may be implemented by using various methods, which is described in detail through specific embodiments in the following.

Embodiment 1

Figure 4:
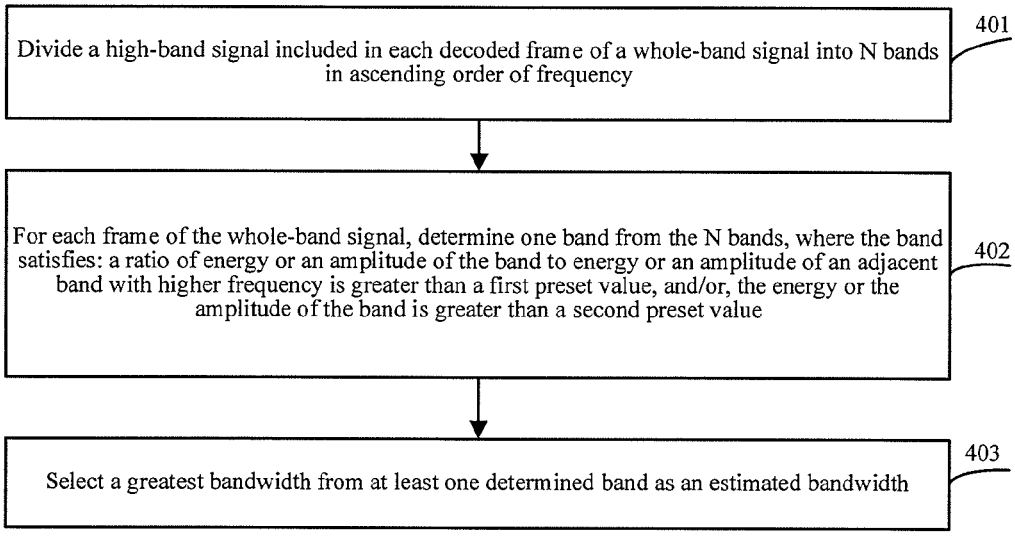
FIG. 4 is a schematic flow chart of Embodiment 1 of obtaining an estimated bandwidth in the bandwidth expansion method shown in FIG. 1.

Referring to FIG. 4, FIG. 4 is a schematic flow chart of a method for obtaining an estimated bandwidth according to an embodiment of the present invention, which may be applied to the bandwidth expansion method shown in FIG. 1. As shown in FIG. 4, the method may include the following steps.

401: Divide a high-band signal included in each decoded frame of a whole-band signal into N bands in ascending order of frequency, where N is an integer greater than 1.

402: For each frame of the whole-band signal, determine one band from the N bands, where the band satisfies: a ratio of energy or an amplitude of the band to energy or an amplitude of an adjacent band with higher frequency is greater than a first preset value, and/or, the energy or the amplitude of the band is greater than a second preset value.

For example, an $(M-1)^{th}$ band may be determined from the N bands of each frame of whole-band signal, where a relationship between $E_{M-1}$ of the $(M-1)^{th}$ band and $E_M$ of an $M^{th}$ band satisfies: $E_{M-1}>\alpha*E_M$;

and/or, a relationship between $E_{M-1}$ of the $(M-1)^{th}$ band and a Threshold satisfies: $E_{M-1}>\text{Threshold}$, where $M\leq N$, $E_M$ represents energy or amplitude information of the $M^{th}$ band, $E_{M-1}$ represents energy or amplitude information of the $(M-1)^{th}$ band, $\alpha$ is a first preset value greater than 1, and the Threshold is a second preset value of energy or amplitude information within a given band.

403: Select a greatest bandwidth from at least one determined band as the estimated bandwidth.

In the embodiment of the present invention, all the determined bands may be traversed, and the greatest bandwidth is selected as the estimated bandwidth.

In Embodiment 1, determination may be started from a first determined band, if a bandwidth of a band determined next is greater than a bandwidth of a band determined before, the bandwidth of the band determined before is updated, otherwise, the bandwidth of the band determined before is kept unchanged until a lower-band signal emerges, and the currently kept bandwidth may be used as an estimated bandwidth corresponding to a whole-band signal that the lower-band signal is expanded into. In Embodiment 1, the estimated bandwidth corresponding to the whole-band signal that the lower-band signal is expanded into may be estimated more accurately, thereby avoiding an audio influence on a user due to a default bandwidth. Therefore, in the embodiment of the present invention, the audio influence on the user may be reduced, and user experience may be improved.

Embodiment 2

Figure 5:
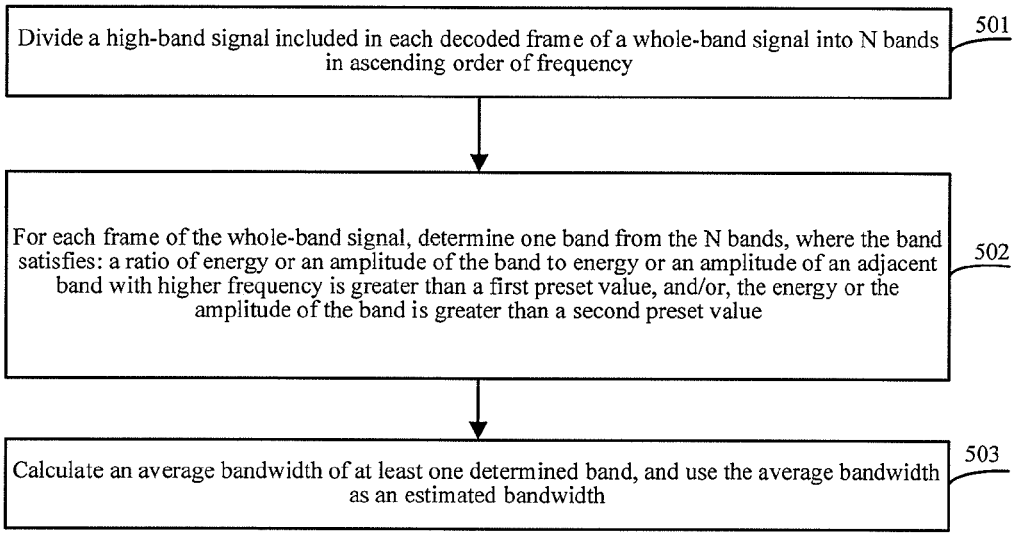
FIG. 5 is a schematic flow chart of Embodiment 2 of obtaining an estimated bandwidth in the bandwidth expansion method shown in FIG. 1.

Referring to FIG. 5, FIG. 5 is a schematic flow chart of another method for obtaining an estimated bandwidth according to an embodiment of the present invention, which may be applied to the bandwidth expansion method shown in FIG. 1. As shown in FIG. 5, the method may include the following steps.

501: Divide a high-band signal included in each decoded frame of a whole-band signal into N bands in ascending order of frequency, where N is an integer greater than 1.

502: For each frame of the whole-band signal, determine one band from the N bands, where the band satisfies: a ratio of energy or an amplitude of the band to energy or an amplitude of an adjacent band with higher frequency is greater than a first preset value, and/or, the energy or the amplitude of the band is greater than a second preset value.

For example, an $(M-1)^{th}$ band may be determined from the N bands of each frame of the whole-band signal, where a relationship between $E_{M-1}$ of the $(M-1)^{th}$ band and $E_M$ of an $M^{th}$ band satisfies: $E_{M-1}>\alpha*E_M$;

and/or, a relationship between $E_{M-1}$ of the $(M-1)^{th}$ band and a Threshold satisfies: $E_{M-1}>\text{Threshold}$, where $M\leq N$, $E_M$ represents energy or amplitude information of the $M^{th}$ band, $E_{M-1}$ represents energy or amplitude information of the $(M-1)^{th}$ band, $\alpha$ is a first preset value greater than 1, and the Threshold is a second preset value of the energy or the amplitude information within a given band.

503: Calculate an average bandwidth of at least one determined band, and use the average bandwidth as the estimated bandwidth.

In Embodiment 2, a bandwidth of each determined band may be recorded until a lower-band signal emerges, and the average bandwidth may be calculated according to bandwidths of all recorded bands or bandwidths of part of the recorded bands. The average bandwidth obtained through solution is used as an estimated bandwidth corresponding to a whole-band signal that the lower-band signal is expanded into. In Embodiment 2, the estimated bandwidth corresponding to the whole-band signal that the lower-band signal is expanded into may be estimated more accurately, thereby avoiding an audio influence on a user due to a default bandwidth. Therefore, in the embodiment of the present invention, the audio influence on the user may be reduced, and user experience may be improved.

Embodiment 3

Figure 6:
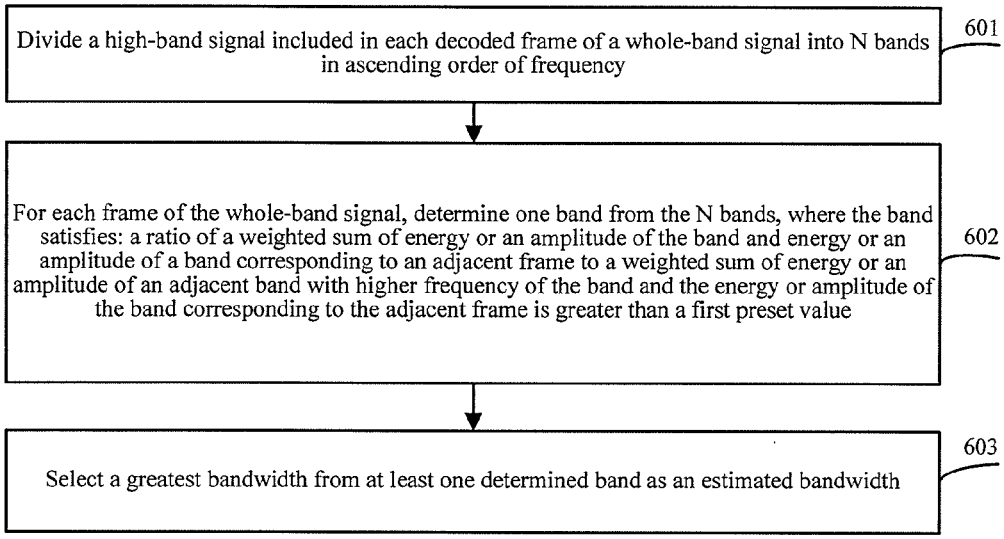
FIG. 6 is a schematic flow chart of Embodiment 3 of obtaining an estimated bandwidth in the bandwidth expansion method shown in FIG. 1.

Referring to FIG. 6, FIG. 6 is a schematic flow chart of another method for obtaining an estimated bandwidth according to an embodiment of the present invention, which may be applied to the bandwidth expansion method shown in FIG. 1. As shown in FIG. 6, the method may include the following steps.

601: Divide a high-band signal included in each decoded frame of a whole-band signal into N bands in ascending order of frequency, where N is an integer greater than 1.

602: For each frame of the whole-band signal, determine one band from the N bands, where the band satisfies: a ratio of a weighted sum of energy or an amplitude of the band and energy or an amplitude of a band corresponding to an adjacent frame to a weighted sum of energy or an amplitude of an adjacent band with higher frequency of the band and the energy or amplitude of the band corresponding to the adjacent frame is greater than a first preset value.

For example, it is assumed that a weighted sum of energy or amplitudes of $M^{th}$ bands within N bands in each frame of the whole-band signal and within N bands in its adjacent frame of the whole-band signal is $E_{SUM,M}$; and a weighted sum of energy or amplitudes of $(M-1)^{th}$ bands within N bands in the whole-band signal and within N bands in its adjacent frame of the whole-band signal is $E_{SUM,M-1}$; a relationship between $E_{SUM,M}$ and $E_{SUM,M-1}$ satisfies: $E_{SUM,M-1}>\alpha*E_{SUM,M}$, where $\alpha$ is a first preset value greater than 1.

603: Select a greatest bandwidth from at least one determined band as the estimated bandwidth.

In the embodiment of the present invention, all the determined bands may be traversed, and the greatest bandwidth is selected as the estimated bandwidth.

In the same way, in Embodiment 3, determination may be started from a first determined band, if a bandwidth of a band determined next is greater than a bandwidth of a band determined before, the bandwidth of the band determined before is updated, otherwise, the bandwidth of the band determined before is kept unchanged until a lower-band signal emerges, and the currently kept bandwidth may be used as an estimated bandwidth corresponding to a whole-band signal that the lower-band signal is expanded into. In Embodiment 3, the estimated bandwidth corresponding to the whole-band signal that the lower-band signal is expanded into may be estimated more accurately, thereby avoiding an audio influence on a user due to the default bandwidth. Therefore, in the embodiment of the present invention, the audio influence on the user may be reduced, and the user experience may be improved.

Embodiment 4

Figure 7:
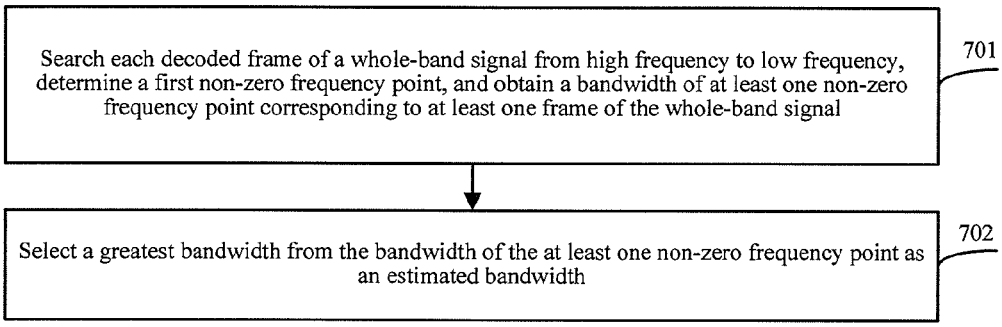
FIG. 7 is a schematic flow chart of Embodiment 4 of obtaining an estimated bandwidth in the bandwidth expansion method shown in FIG. 1.

Referring to FIG. 7, FIG. 7 is a schematic flow chart of another method for obtaining an estimated bandwidth according to an embodiment of the present invention, which may be applied to the bandwidth expansion method shown in FIG. 1. As shown in FIG. 7, the method may include the following steps.

701: Search each decoded frame of a whole-band signal from high frequency to low frequency, determine a first non-zero frequency point, and obtain a bandwidth of at least one non-zero frequency point corresponding to at least one frame of the whole-band signal.

702: Select a greatest bandwidth from the bandwidth of the at least one non-zero frequency point as the estimated bandwidth.

In the same way, in Embodiment 4, determination may be started from a first determined frequency point, if a bandwidth of a frequency point determined next is greater than a bandwidth of a frequency point determined before, the bandwidth of the frequency point determined before is updated, otherwise, the bandwidth of the frequency point determined before is kept unchanged until a lower-band signal emerges, and the currently kept bandwidth may be used as an estimated bandwidth corresponding to a whole-band signal that the lower-band signal is expanded into. In Embodiment 4, the estimated bandwidth corresponding to the whole-band signal that the lower-band signal is expanded into may be estimated more accurately, thereby avoiding an audio influence on a user due to the default bandwidth. Therefore, in the embodiment of the present invention, the audio influence on the user may be reduced, and the user experience may be improved.

The bandwidth expansion method provided in the embodiment of the present invention may also be applied to a multi-mode coding/decoding algorithm. For example, in some modes, a code stream after coding may include information of a whole band, and by decoding the code stream during decoding, the information of the whole band may be restored. In other modes, the code stream after coding only include part of low frequency information, and by decoding the code stream during decoding, the low frequency information may be restored. High frequency information needs to be obtained through prediction. When the high frequency information is predicted, a bandwidth needs to be estimated through the restored information of the whole band. The bandwidth may be estimated in any method in Embodiment 1 to Embodiment 4.

The bandwidth expansion method provided in the embodiment of the present invention may also be applied to a packet loss compensation algorithm or a frame loss compensation algorithm. When frame loss occurs, in order to obtain a better decoded signal, a signal of a current loss frame needs to be restored through information of a previous frame and a next frame. For the same problem, a bandwidth of the restored signal needs to be determined through an estimated bandwidth of a decoded previous frame. A signal in a band below the estimated bandwidth is restored through the existing packet loss compensation algorithm or the existing frame loss compensation algorithm, and a signal in a band above the estimated bandwidth is obtained through information of a band the same as a band of a previous frame, or through a given value, or by attenuating information of the current frame in a band below an effective bandwidth.

Figure 8:
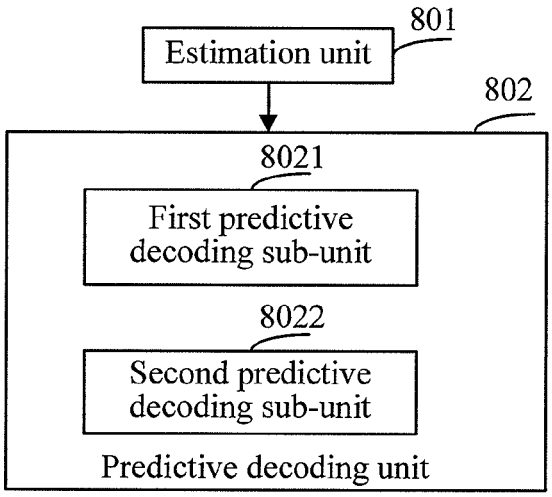
FIG. 8 is a schematic structural diagram of a bandwidth expansion apparatus according to an embodiment of the present invention.

Referring to FIG. 8, FIG. 8 is a schematic structural diagram of a bandwidth expansion apparatus according to an embodiment of the present invention. The bandwidth expansion apparatus provided in the embodiment of the present invention may be applied to various communication terminals, and may also be applied to various base stations. As shown in FIG. 8, the apparatus may include: an estimation unit 801 and a predictive decoding unit 802.

The estimation unit 801 is configured to estimate a bandwidth of at least one decoded frame of a whole-band signal, so as to obtain an estimated bandwidth; where the estimated bandwidth corresponds to a whole-band signal that a decoded lower-band signal needs to be extended into, where the lower-band signal is a decoded signal whose effective bandwidth is smaller than an effective bandwidth of the decoded whole-band signal.

The predictive decoding unit 802 may include:

a first predictive decoding sub-unit 8021, configured to perform first predictive decoding on a part of the lower-band signal in a band above an effective bandwidth of the lower-band signal and below the estimated bandwidth, so as to obtain the part of the lower-band signal above the effective bandwidth of the lower-band signal and below the estimated bandwidth; and a second predictive decoding sub-unit 8022, configured to perform second predictive decoding on a part of the lower-band signal in a band above the estimated bandwidth, so as to obtain the part of the lower-band signal above the estimated bandwidth.

In the bandwidth expansion apparatus provided in the embodiment of the present invention, the estimation unit 801 may estimate a bandwidth of a decoded whole-band signal, so as to obtain an estimated bandwidth; the predictive decoding unit 802 may use the estimated bandwidth of the whole-band signal as an estimated bandwidth of a current frame of a lower-band signal, and when the current frame of the lower-band signal is expanded into a whole-band signal, different predictive decoding methods are adopted for a part of the signal in a band above the estimated bandwidth and a part of the signal in a band below the estimated bandwidth. The energy or the amplitude of the band above the estimated bandwidth is smaller than the energy or the amplitude of the band below the estimated bandwidth. Compared with the manner of using a default bandwidth, in the embodiment of the present invention, a bad audio influence introduced because of the prediction of an additional signal component is reduced in the band above the estimated bandwidth, thereby reducing an audio influence on a user, and improving the user experience.

Figure 9:
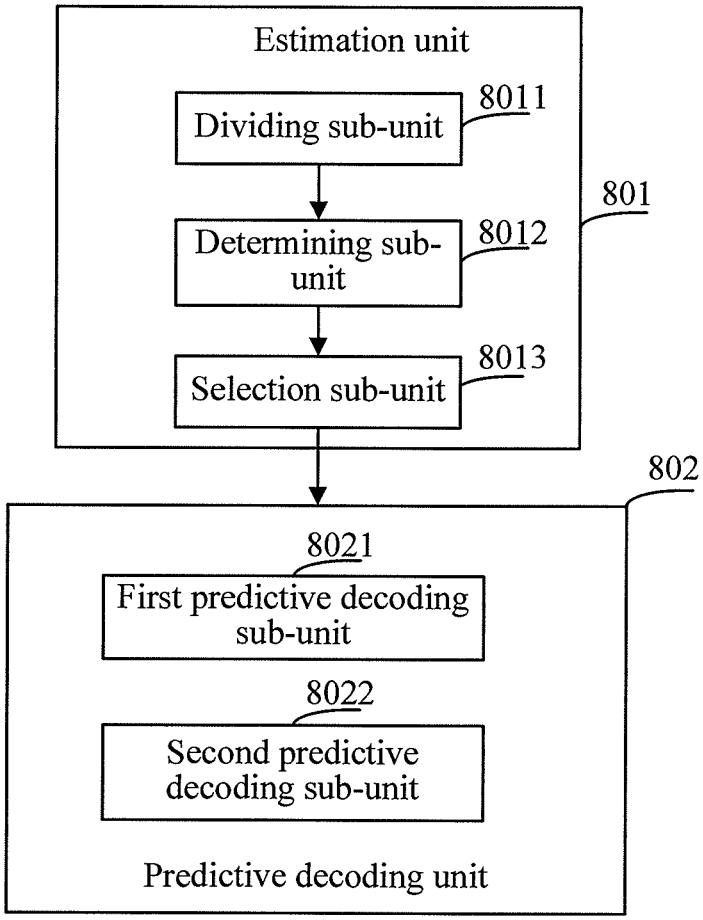
FIG. 9 is a schematic structural diagram of another bandwidth expansion apparatus according to an embodiment of the present invention.

Referring to FIG. 9 as well, FIG. 9 is a schematic structural diagram of another bandwidth expansion apparatus according to an embodiment of the present invention. The bandwidth expansion apparatus shown in FIG. 9 is obtained by optimizing the bandwidth expansion apparatus shown in FIG. 8. In the bandwidth expansion apparatus shown in FIG. 9, the estimation unit 801 may include:

a dividing sub-unit 8011, configured to divide a high-band signal included in each decoded frame of the whole-band signal into N bands in ascending order of frequency, where N is an integer greater than 1;

a determining sub-unit 8012, configured to, for each frame of the whole-band signal, determine one band from the N bands, where the band satisfies: a ratio of energy or an amplitude of the band to energy or an amplitude of an adjacent band with higher frequency is greater than a first preset value, and/or, the energy or the amplitude of the band is greater than a second preset value, where for example, the determining sub-unit 8012 may determine an $(M-1)^{th}$ band from the N bands of each frame of the whole-band signal, where a relationship between $E_{M-1}$ of the $(M-1)^{th}$ band and $E_M$ of an $M^{th}$ band satisfies: $E_{M-1}>\alpha*E_M$; and/or, a relationship between $E_{M-1}$ of the $(M-1)^{th}$ band and a Threshold satisfies: $E_{M-1}$>Threshold; where M, $E_M$ represents energy or amplitude information of the $M^{th}$ band, $E_{M-1}$ represents energy or amplitude information of the $(M-1)^{th}$ band, $\alpha$ is a first preset value greater than 1, and the Threshold is a second preset value of energy or amplitude information within a given band; and a selection sub-unit 8013, configured to select a greatest bandwidth from at least one band determined by the determining sub-unit 8012 as the estimated bandwidth.

Figure 10:
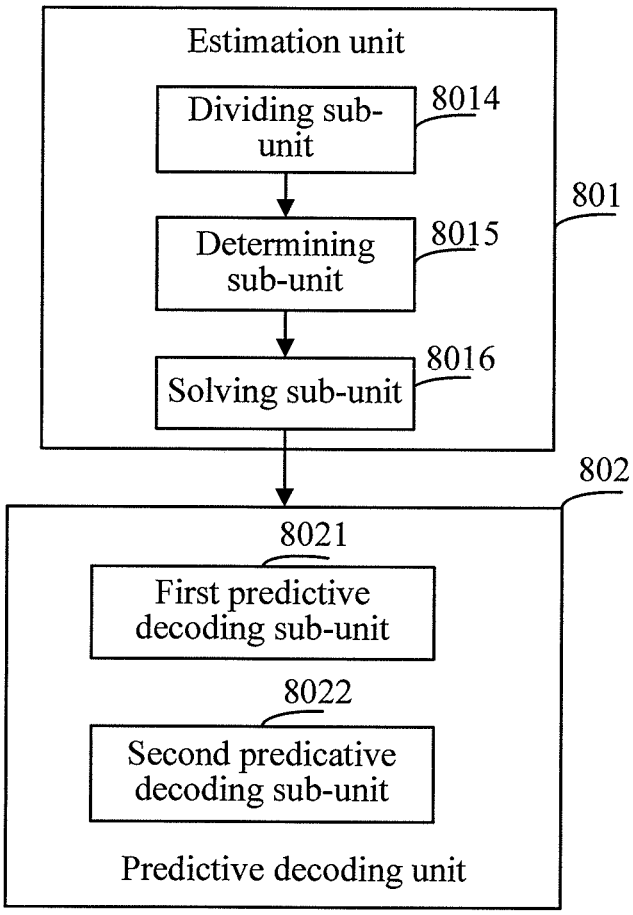
FIG. 10 is a schematic structural diagram of another bandwidth expansion apparatus according to an embodiment of the present invention.

Referring to FIG. 10 as well, FIG. 10 is a schematic structural diagram of another bandwidth expansion apparatus according to an embodiment of the present invention. The bandwidth expansion apparatus shown in FIG. 10 is obtained by optimizing the bandwidth expansion apparatus shown in FIG. 8. In the bandwidth expansion apparatus shown in FIG. 10, the estimation unit 801 may include:

a dividing sub-unit 8014, configured to divide a high-band signal included in each decoded frame of the whole-band signal into N bands in ascending order of frequency, where N is an integer greater than;

a determining sub-unit 8015, configured to, for each frame of the whole-band signal, determine one band from the N bands, where the band satisfies: a ratio of energy or an amplitude of the band to energy or an amplitude of an adjacent band with higher frequency is greater than a first preset value, and/or, the energy or the amplitude of the band is greater than a second preset value; and a solving sub-unit 8016, configured to calculate an average bandwidth of at least one band determined by the determining sub-unit 8015, and use the average bandwidth as the estimated bandwidth.

Figure 11:
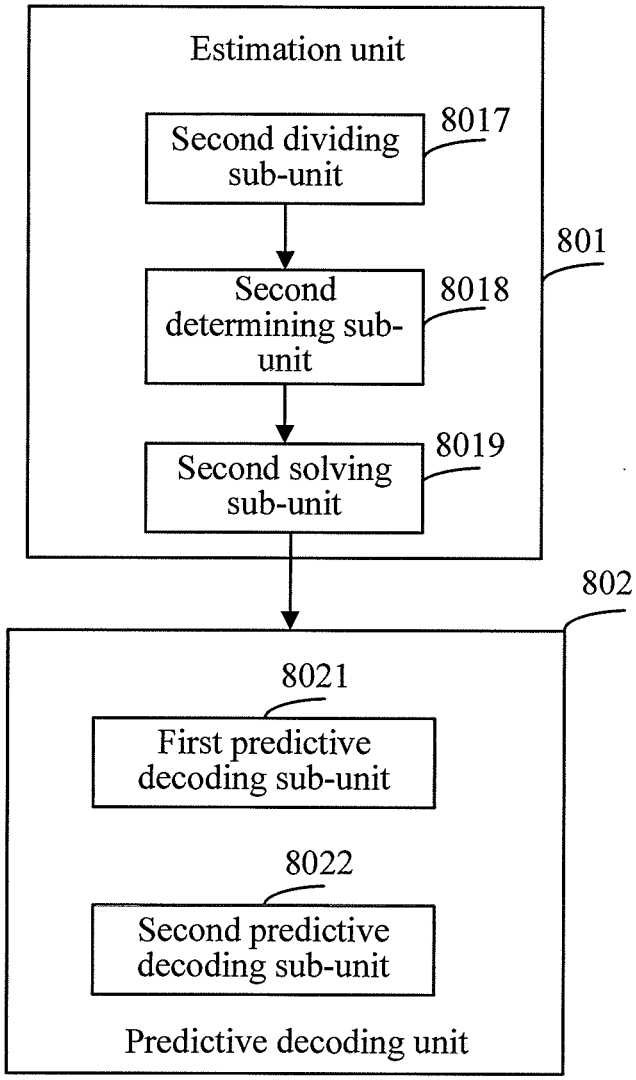
FIG. 11 is a schematic structural diagram of another bandwidth expansion apparatus according to an embodiment of the present invention.

Referring to FIG. 11 as well, FIG. 11 is a schematic structural diagram of another bandwidth expansion apparatus according to an embodiment of the present invention. The bandwidth expansion apparatus shown in FIG. 11 is obtained by optimizing the bandwidth expansion apparatus shown in FIG. 8. In the bandwidth expansion apparatus shown in FIG. 11, the estimation unit 801 may include:

a second dividing sub-unit 8017, configured to divide a high-band signal included in each decoded frame of the whole-band signal into N bands in ascending order of frequency, where N is an integer greater than 1;

a second determining sub-unit 8018, configured to, for each frame of the whole-band signal, determine one band from the N bands, where the band satisfies: a ratio of a weighted sum of energy or an amplitude of the band and energy or an amplitude of a band corresponding to an adjacent frame to a weighted sum of energy or an amplitude of an adjacent band with higher frequency of the band and the energy or amplitude of the band corresponding to the adjacent frame is greater than a first preset value; and a second selection sub-unit 8019, configured to select a greatest bandwidth from at least one band determined by the second determining sub-unit 8018 as the estimated bandwidth.

Figure 12:
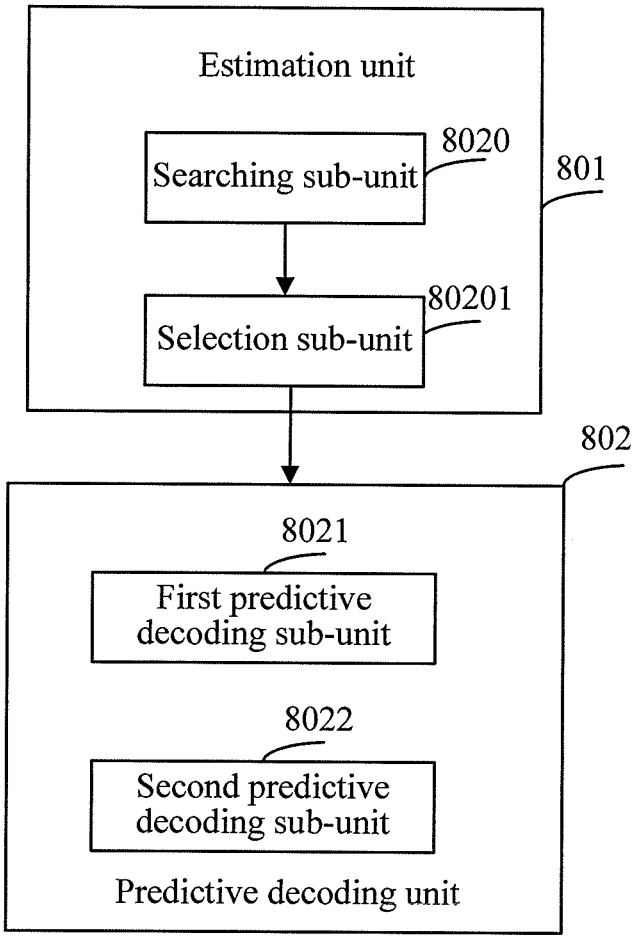
FIG. 12 is a schematic structural diagram of another bandwidth expansion apparatus according to an embodiment of the present invention.

Referring to FIG. 12 as well, FIG. 12 is a schematic structural diagram of another bandwidth expansion apparatus according to an embodiment of the present invention. The bandwidth expansion apparatus shown in FIG. 11 is obtained by optimizing the bandwidth expansion apparatus shown in FIG. 8. In the bandwidth expansion apparatus shown in FIG. 11, the estimation unit 801 may include:

a searching sub-unit 8020, configured to search each decoded frame of a whole-band signal from high frequency to low frequency, determine a first non-zero frequency point, and obtain a bandwidth of at least one non-zero frequency point corresponding to at least one frame of the whole-band signal; and a selection sub-unit 80201, configured to select a greatest bandwidth from the bandwidth of the at least one non-zero frequency point determined by the searching sub-unit 8020 as the estimated bandwidth.

Figure 13:
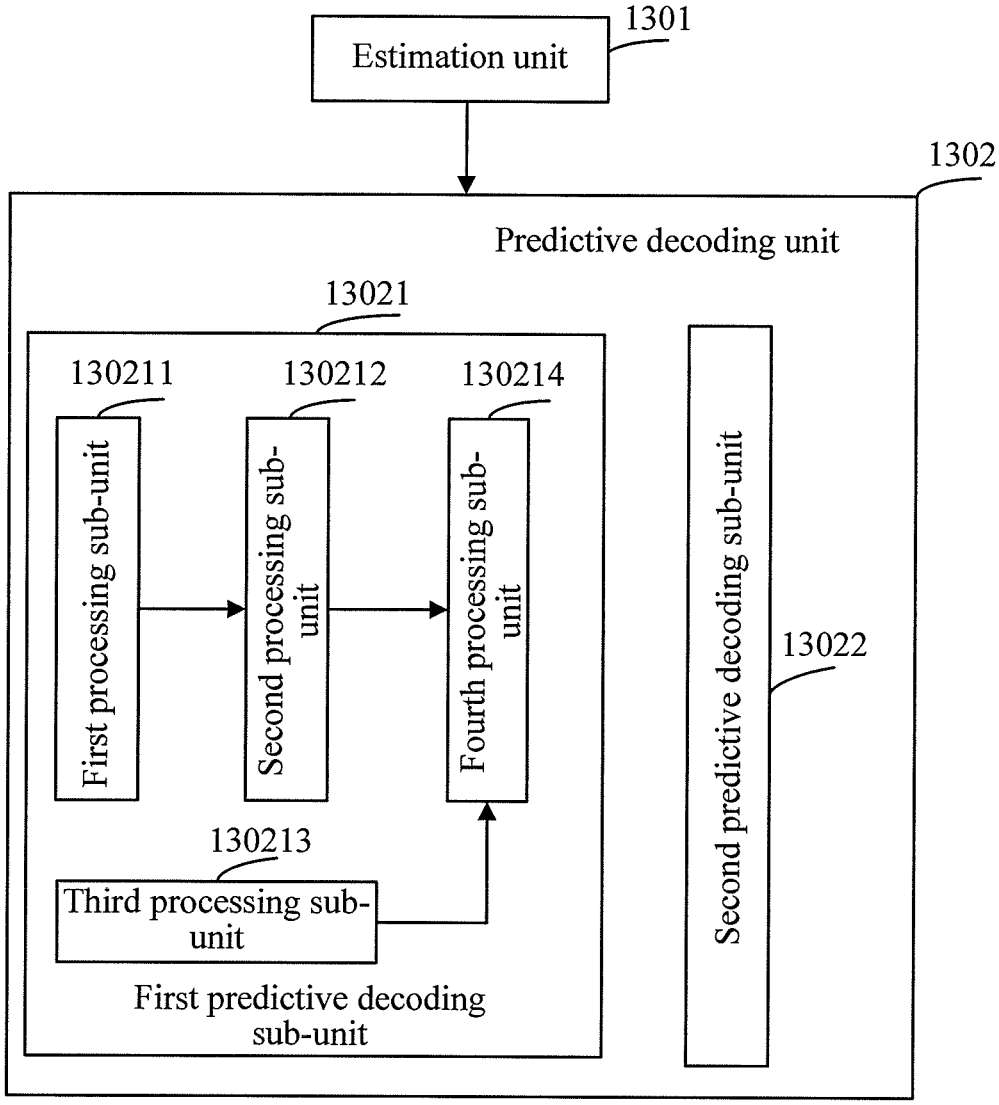
FIG. 13 is a schematic structural diagram of another bandwidth expansion apparatus according to an embodiment of the present invention.

Referring to FIG. 13 as well, FIG. 13 is a schematic structural diagram of another bandwidth expansion apparatus according to an embodiment of the present invention, where the bandwidth expansion apparatus shown in FIG. 13 may include:

an estimation unit 1301 and a predictive decoding unit 1302.

The estimation unit 1301 is configured to estimate a bandwidth of at least one decoded frame of a whole-band signal, so as to obtain an estimated bandwidth; where the estimated bandwidth corresponds to a whole-band signal that a decoded lower-band signal needs to be extended into.

In this embodiment, the structure and the function of the estimation unit 1301 are the same as those of any estimation unit 801 in FIG. 9 to FIG. 12.

The predictive decoding unit 1302 may include:

a first predictive decoding sub-unit 13021, configured to perform first predictive decoding on a part of the lower-band signal in a band above an effective bandwidth of the lower-band signal and below the estimated bandwidth, so as to obtain the part of the lower-band signal above the effective bandwidth of the lower-band signal and below the estimated bandwidth; and a second predictive decoding sub-unit 13022, configured to perform second predictive decoding on a part of the lower-band signal in a band above the estimated bandwidth, so as to obtain the part of the lower-band signal above the estimated bandwidth.

As shown in FIG. 13, the first predictive decoding sub-unit 13021 may include:

a first processing sub-unit 130211, configured to calculate energy or amplitude information of a high-band signal included in the decoded whole-band signal, and calculate energy or amplitude information of a certain frequency range included in the lower-band signal;

a second processing sub-unit 130212, configured to predict energy of the lower-band signal above the effective bandwidth of the lower-band signal and below the estimated bandwidth by weighting the energy of the high-band signal included in the decoded whole-band signal and the energy of the certain frequency range included in the lower-band signal; or predict amplitude information of the lower-band signal above the effective bandwidth of the lower-band signal and below the estimated bandwidth by weighting the amplitude information of the high-band signal included in the decoded whole-band signal and the amplitude information of the certain frequency range included in the lower-band signal;

a third processing sub-unit 130213, configured to predict an excitation signal of the lower-band signal above the effective bandwidth of the lower-band signal and below the estimated bandwidth through an excitation signal of the high-band signal included in the whole-band signal or the lower-band signal; and a fourth processing sub-unit 130214, configured to restore the part of the lower-band signal above the effective bandwidth of the lower-band signal and below the estimated bandwidth according to the excitation signal of the lower-band signal above the effective bandwidth of the lower-band signal and below the estimated bandwidth, and the energy or the amplitude information of the lower-band signal above the effective bandwidth of the lower-band signal and below the estimated bandwidth.

The first processing sub-unit 130211 is specifically configured to divide the high-band signal included in the decoded whole-band signal and the certain frequency range included in the lower-band signal each into a same number of bands, calculate energy or amplitude information of each band, obtain the energy or the amplitude information of the high-band signal included in the decoded whole-band signal, and obtain the energy or the amplitude information of the certain frequency range included in the lower-band signal.

Figure 14:
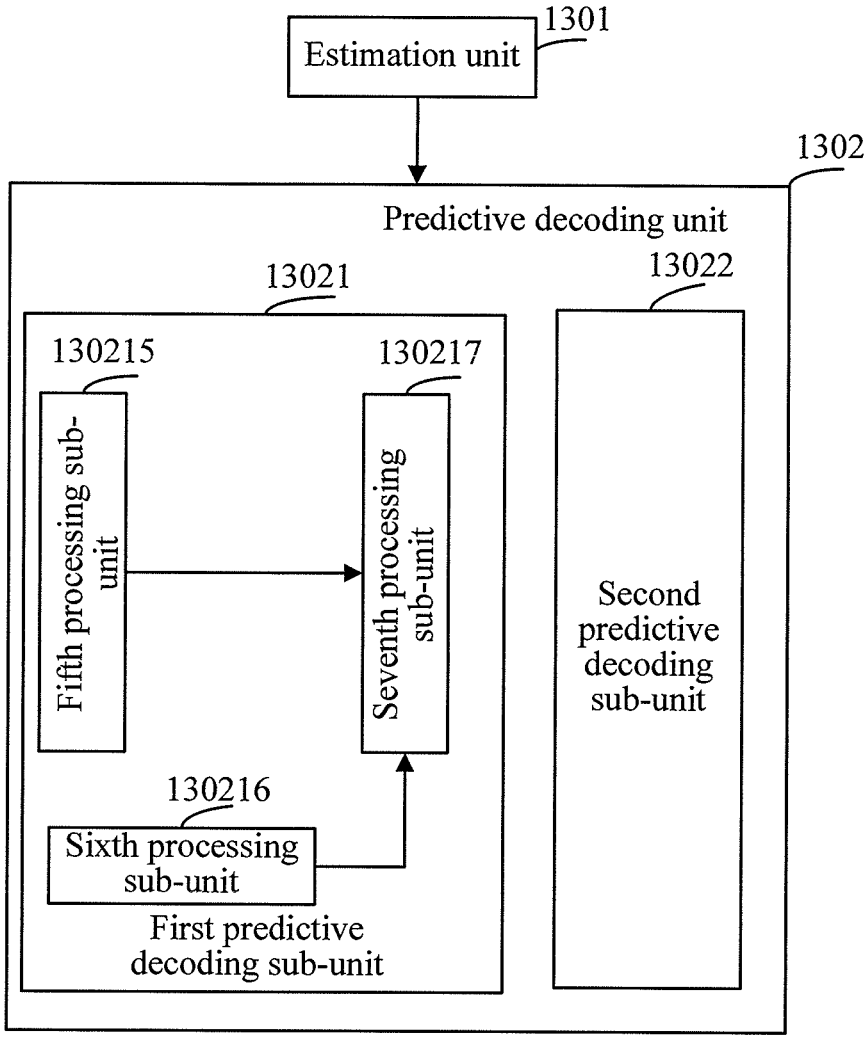
FIG. 14 is a schematic structural diagram of still another bandwidth expansion apparatus according to an embodiment of the present invention.

Referring to FIG. 14 as well, FIG. 14 is a schematic structural diagram of another bandwidth expansion apparatus according to an embodiment of the present invention. In the bandwidth expansion apparatus shown in FIG. 14, the first predictive decoding sub-unit 13021 may include:

a fifth processing sub-unit 130215, configured to obtain, through prediction, energy or amplitude information of the lower-band signal above the effective bandwidth of the lower-band signal and below the estimated bandwidth from the lower-band signal or a high-band signal included in the decoded whole-band signal;

a sixth processing sub-unit 130216, configured to obtain, through prediction, an excitation signal of the lower-band signal above the effective bandwidth of the lower-band signal and below the estimated bandwidth from the high-band signal included in the decoded whole-band signal or the lower-band signal; and a seventh processing sub-unit 130217, configured to restore the part of the lower-band signal above the effective bandwidth of the lower-band signal and below the estimated bandwidth according to the excitation signal of the lower-band signal above the effective bandwidth of the lower-band signal and below the estimated bandwidth, and the energy or the amplitude information of the lower-band signal above the effective bandwidth of the lower-band signal and below the estimated bandwidth.

The foregoing energy or amplitude information may be a frequency domain envelope.

Figure 15:
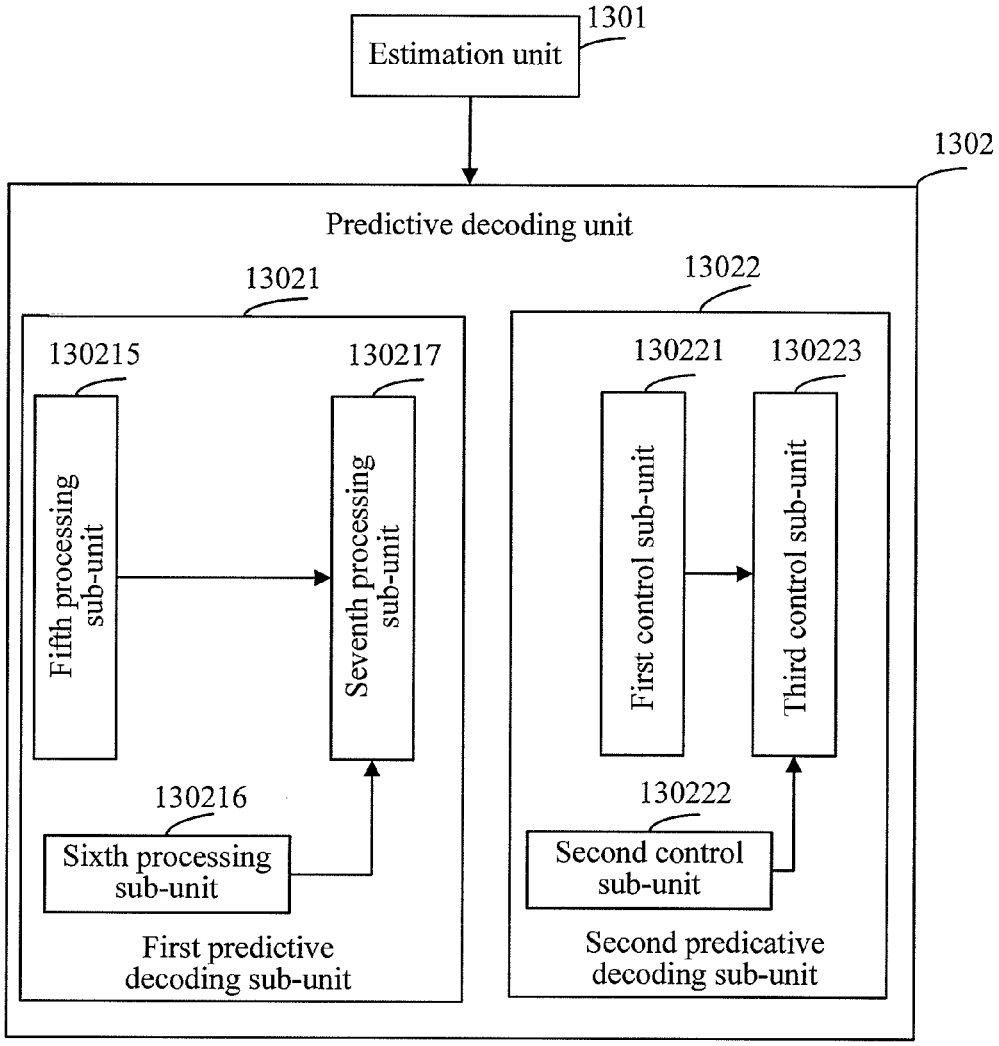
FIG. 15 is a schematic structural diagram of yet another bandwidth expansion apparatus according to an embodiment of the present invention.

Referring to FIG. 15 as well, FIG. 15 is a schematic structural diagram of another bandwidth expansion apparatus according to an embodiment of the present invention. The bandwidth expansion apparatus shown in FIG. 15 is obtained by optimizing the bandwidth expansion apparatus shown in FIG. 8. In the bandwidth expansion apparatus shown in FIG. 15, the second predictive decoding sub-unit 13022 may include:

a first control sub-unit 130221, configured to determine energy or an amplitude, smaller than energy or amplitude information of the lower-band signal below the estimated bandwidth, as energy or amplitude information of the lower-band signal above the estimated bandwidth, where as an optional implementation manner, the first control sub-unit 130221 may be configured to use energy or amplitude information of the decoded whole-band signal above the estimated bandwidth as the energy or the amplitude information of the lower-band signal above the estimated bandwidth; or use preset energy or amplitude information as the energy or the amplitude information of the lower-band signal above the estimated bandwidth, where the preset energy or amplitude is smaller than the energy or the amplitude of the energy or the amplitude information of the lower-band signal below the estimated bandwidth; or attenuate the energy or the amplitude information of the lower-band signal below the estimated bandwidth as the energy or the amplitude information of the lower-band signal above the estimated bandwidth;

a second control sub-unit 130222, configured to predict an excitation signal of the lower-band signal above the estimated bandwidth through an excitation signal of the lower-band signal or a random noise; and a third control sub-unit 130223, configured to restore the part of the lower-band signal above the estimated bandwidth according to the excitation signal of the lower-band signal above the estimated bandwidth and the energy or the amplitude information of the lower-band signal above the estimated bandwidth.

In this embodiment, the structure and the function of the estimation unit 1301 are the same as those of any estimation unit 801 in FIG. 9 to FIG. 12.

In this embodiment, the structure and the function of the first predictive decoding sub-unit 13021 are the same as those of any first predictive decoding sub-unit 13021 in FIG. 13 or FIG. 14.

Persons of ordinary skill in the art may understand that all or part of the steps of the methods in the embodiments may be implemented by a program instructing relevant hardware. The program may be stored in a computer readable storage medium, and the storage medium may include: a flash drive, a read-only memory (Read-Only Memory, ROM), a random access memory (Random Access Memory, RAM), a magnetic disk, or an optical disk.

The bandwidth expansion method and apparatus that are provided in the embodiments of the present invention are introduced in detail above. In this specification, specific examples are used for illustrating principles and implementation manners of the present invention. The foregoing descriptions of the embodiments are merely used to help understand the method and core idea of the present invention. Meanwhile, persons skilled in the art may make modifications to the specific implementation manners and application scopes according to the idea of the present invention. In conclusion, the content of the specification shall not be construed as a limitation to the present invention.

What is claimed is:

1. A bandwidth expansion method, comprising:

estimating a bandwidth of at least one previously decoded frame of a whole-band signal, so as to obtain an estimated bandwidth; wherein the estimated bandwidth is used as the estimated bandwidth of a current frame of a lower-band signal;

performing bandwidth expansion for the lower-band signal by using different predictive decoding on the lower-band signal according to an effective bandwidth of the lower-band signal and the estimated bandwidth, comprising:

performing first predictive decoding on a part of the lower-band signal in a band above an effective bandwidth of the lower-band signal and below the estimated bandwidth, so as to obtain the part of the lower-band signal above the effective bandwidth of the lower-band signal and below the estimated bandwidth; and performing second predictive decoding on a part of the lower-band signal in a band above the estimated bandwidth, so as to obtain the part of the lower-band signal above the estimated bandwidth.

2. The method according to claim 1, wherein estimating a bandwidth of a decoded whole-band signal, so as to obtain an estimated bandwidth, comprises:

dividing a high-band signal comprised in each decoded frame of the whole-band signal into N bands in ascending order of frequency, wherein N is an integer greater than 1;

for each frame of the whole-band signal, determining one band from the N bands, wherein the band satisfies: a ratio of energy or an amplitude of the band to energy or an amplitude of an adjacent band with higher frequency is greater than a first preset value, and/or, the energy or the amplitude of the band is greater than a second preset value; and selecting a greatest bandwidth from at least one determined band as the estimated bandwidth.

3. The method according to claim 1, wherein estimating a bandwidth of a decoded whole-band signal, so as to obtain an estimated bandwidth, comprises:

dividing a high-band signal comprised in each decoded frame of the whole-band signal into N bands in ascending order of frequency, wherein N is an integer greater than 1;

for each frame of the whole-band signal, determining one band from the N bands, wherein the band satisfies: a ratio of energy or an amplitude of the band to energy or an amplitude of an adjacent band with higher frequency is greater than a first preset value, and/or, the energy or the amplitude of the band is greater than a second preset value; and calculating an average bandwidth of at least one determined band, and using the average bandwidth as the estimated bandwidth.

4. The method according to claim 1, wherein estimating a bandwidth of a decoded whole-band signal, so as to obtain an estimated bandwidth, comprises:

dividing a high-band signal comprised in each decoded frame of the whole-band signal into N bands in ascending order of frequency, wherein N is an integer greater than 1;

for each frame of the whole-band signal, determining one band from the N bands, wherein the band satisfies: a ratio of a weighted sum of energy or an amplitude of the band and energy or an amplitude of a band corresponding to an adjacent frame to a weighted sum of energy or an amplitudes of an adjacent band with higher frequency of the band and the energy or amplitude of the band corresponding to the adjacent frame is greater than a first preset value; and selecting a greatest bandwidth from at least one determined band as the estimated bandwidth.

5. The method according to claim 1, wherein estimating a bandwidth of a decoded whole-band signal, so as to obtain an estimated bandwidth, comprises:

searching each decoded frame of the whole-band signal from high frequency to low frequency, determining a first non-zero frequency point, and obtaining a bandwidth of at least one non-zero frequency point corresponding to at least one frame of the whole-band signal; and selecting a greatest bandwidth from the bandwidth of the at least one non-zero frequency point as the estimated bandwidth.

6. The method according to claim 1, wherein performing first predictive decoding on a part of the lower-band signal in a band above an effective bandwidth of the lower-band signal and below the estimated bandwidth, so as to obtain the part of the lower-band signal above the effective bandwidth of the lower-band signal and below the estimated bandwidth, comprises:

solving for energy or amplitude information of a high-band signal comprised in the decoded whole-band signal, and solving for energy or amplitude information of a certain frequency range comprised in the lower-band signal;

predicting energy of lower-band signal above the effective bandwidth of the lower-band signal and below the estimated bandwidth by weighting the energy of the high-band signal comprised in the decoded whole-band signal and the energy of the certain frequency range comprised in the lower-band signal; or predicting amplitude information of the lower-band signal above the effective bandwidth of the lower-band signal and below the estimated bandwidth by weighting amplitude information of the high-band signal comprised in the decoded whole-band signal and amplitude information of the certain frequency range comprised in the lower-band signal;

predicting an excitation signal of the lower-band signal above the effective bandwidth of the lower-band signal and below the estimated bandwidth through an excitation signal of the high-band signal comprised in the lower-band signal or the whole-band signal; and restoring the part of the lower-band signal above the effective bandwidth of the lower-band signal and below the estimated bandwidth according to the excitation signal of the lower-band signal above the effective bandwidth of the lower-band signal and below the estimated bandwidth, and the energy or the amplitude information of the lower-band signal above the effective bandwidth of the lower-band signal and below the estimated bandwidth.

7. The method according to claim 6, wherein solving for energy or amplitude information of a high-band signal comprised in the decoded whole-band signal, and solving for energy or amplitude information of the certain frequency range comprised in the lower-band signal, comprises:

dividing the high-band signal comprised in the decoded whole-band signal and the certain frequency range comprised in the lower-band signal each into a same number of bands, solving for energy or amplitude information of each band, obtaining the energy or the amplitude information of the high-band signal comprised in the decoded whole-band signal, and obtaining the energy or the amplitude information of the certain frequency range comprised in the lower-band signal.

8. The method according to claim 1, wherein performing second predictive decoding on a part of the lower-band signal in a band above the estimated bandwidth, so as to obtain signal above the estimated bandwidth, comprises:

determining energy or an amplitude, smaller than energy or amplitude information of the lower-band signal below the estimated bandwidth, as energy or amplitude information of the lower-band signal above the estimated bandwidth;

predicting an excitation signal of the lower-band signal above the estimated bandwidth through an excitation signal of the lower-band signal or a random noise; and restoring the part of the lower-band signal above the estimated bandwidth according to the excitation signal of the lower-band signal above the estimated bandwidth and the energy or the amplitude information of the lower-band signal above the estimated bandwidth.

9. The method according to claim 8, wherein determining energy or an amplitude, smaller than energy or amplitude information of the lower-band signal below the estimated bandwidth, as energy or amplitude information of the lower-band signal above the estimated bandwidth comprises:

using energy or amplitude information of the decoded whole-band signal above the estimated bandwidth as the energy or the amplitude information of the lower-band signal above the estimated bandwidth; or using preset energy or amplitude information as the energy or the amplitude information of the lower-band signal above the estimated bandwidth, wherein the preset energy or amplitude is smaller than the energy or the amplitude of the energy or the amplitude information of the lower-band signal below the estimated bandwidth; or attenuating the energy or the amplitude information of the lower-band signal below the estimated bandwidth as the energy or the amplitude information of the lower-band signal above the estimated bandwidth.

10. A bandwidth expansion apparatus, comprising a processor, an estimation unit coupled to the processor, and a predictive decoding unit coupled to the processor;

the estimation unit is configured to estimate a bandwidth of at least one previously decoded frame of a whole-band signal, so as to obtain an estimated bandwidth; wherein the estimated bandwidth is used as the estimated bandwidth of a current frame of a lower-band signal; and the predictive decoding unit is configured to perform bandwidth expansion for the lower-band signal by using different predictive decoding on the lower-band signal according to an effective bandwidth of the lower-band signal and the estimated bandwidth, comprising:

a first predictive decoding sub-unit, configured to perform first predictive decoding on a part of the lower-band signal in a band above an effective bandwidth of the lower-band signal and below the estimated bandwidth, so as to obtain the part of the lower-band signal above the effective bandwidth of the lower-band signal and below the estimated bandwidth; and a second predictive decoding sub-unit, configured to perform second predictive decoding on a part of the lower-band signal in a band above the estimated bandwidth, so as to obtain the part of the lower-band signal above the estimated bandwidth.

11. The apparatus according to claim 10, wherein the estimation unit comprises:

a dividing sub-unit, configured to divide a high-band signal comprised in each decoded frame of the whole-band signal into N bands in ascending order of frequency, wherein N is an integer greater than 1;

a determining sub-unit, configured to, for each frame of the whole-band signal, determine one band from the N bands, wherein the band satisfies: a ratio of energy or an amplitude of the band to energy or an amplitude of an adjacent band with higher frequency is greater than a first preset value, and/or, the energy or the amplitude of the band is greater than a second preset value; and a selection sub-unit, configured to select a greatest bandwidth from at least one band determined by the determining sub-unit as the estimated bandwidth.

12. The apparatus according to claim 10, wherein the estimation unit comprises:

a dividing sub-unit, configured to divide a high-band signal comprised in each decoded frame of the whole-band signal into N bands in ascending order of frequency, wherein N is an integer greater than 1;

a determining sub-unit, configured to, for each frame of the whole-band signal, determine one band from the N bands, wherein the band satisfies: a ratio of energy or an amplitude of the band to energy or an amplitude of an adjacent band with higher frequency is greater than a first preset value, and/or, the energy or the amplitude of the band is greater than a second preset value; and a solving sub-unit, configured to calculate an average bandwidth of at least one band determined by the determining sub-unit, and use the average bandwidth as the estimated bandwidth.

13. The apparatus according to claim 10, wherein the estimation unit comprises:

a second dividing sub-unit, configured to divide a high-band signal comprised in each decoded frame of the whole-band signal into N bands in ascending order of frequency, wherein N is an integer greater than 1;

a second determining sub-unit, configured to, for each frame of the whole-band signal, determine one band from the N bands, wherein the band satisfies: a ratio of a weighted sum of energy or an amplitude of the band and energy or an amplitude of a band corresponding to an adjacent frame to a weighted sum of energy or an amplitude of an adjacent band with higher frequency of the band and the energy or amplitude of the band corresponding to the adjacent frame is greater than a first preset value; and a second selection sub-unit, configured to select a greatest bandwidth from at least one band determined by the determining unit as the estimated bandwidth.

14. The apparatus according to claim 10, wherein the estimation unit comprises:

a searching sub-unit, configured to search each decoded frame of the whole-band signal from high frequency to low frequency, determine a first non-zero frequency point, and obtain a bandwidth of at least one non-zero frequency point corresponding to at least one frame of the whole-band signal; and a selection sub-unit, configured to select a greatest bandwidth from the bandwidth of the at least one non-zero frequency point determined by the searching sub-unit as the estimated bandwidth.

15. The apparatus according to claim 10, wherein the first predictive decoding sub-unit comprises:

a first processing sub-unit, configured to calculate energy or amplitude information of a high-band signal comprised in the decoded whole-band signal, and calculate energy or amplitude information of a certain frequency range comprised in the lower-band signal;

a second processing sub-unit, configured to predict energy of the lower-band signal above the effective bandwidth of the lower-band signal and below the estimated bandwidth by weighting the energy of the high-band signal comprised in the decoded whole-band signal and the energy of the certain frequency range comprised in the lower-band signal; or predict amplitude information of the lower-band signal above the effective bandwidth of the lower-band signal and below the estimated bandwidth by weighting amplitude information of the high-band signal comprised in the decoded whole-band signal and amplitude information of the certain frequency range comprised in the lower-band signal;

a third processing sub-unit, configured to predict an excitation signal of the lower-band signal above the effective bandwidth of the lower-band signal and below the estimated bandwidth through an excitation signal of the high-band signal comprised in the lower-band signal or the whole-band signal; and a fourth processing sub-unit, configured to restore the part of the lower-band signal above the effective bandwidth of the lower-band signal and below the estimated bandwidth according to the excitation signal of the lower-band signal above the effective bandwidth of the lower-band signal and below the estimated bandwidth, and the energy or the amplitude information of the lower-band signal above the effective bandwidth of the lower-band signal and below the estimated bandwidth.

16. The apparatus according to claim 15, wherein the first processing sub-unit is configured to divide the high-band signal comprised in the decoded whole-band signal and the certain frequency range comprised in the lower-band signal each into a same number of bands, calculate energy or amplitude information of each band, obtain the energy or the amplitude information of the high-band signal comprised in the decoded whole-band signal, and obtain the energy or the amplitude information of the certain frequency range comprised in the lower-band signal.

17. The apparatus according to claim 10, wherein the second predictive decoding sub-unit comprises:

a first control sub-unit, configured to determine energy or an amplitude, smaller than energy or amplitude information of the lower-band signal below the estimated bandwidth, as the energy or the amplitude information of the lower-band signal above the estimated bandwidth;

a second control sub-unit, configured to predict an excitation signal of the lower-band signal above the estimated bandwidth through an excitation signal of the lower-band signal or a random noise; and a third control sub-unit, configured to restore the part of the lower-band signal above the estimated bandwidth according to the excitation signal of the lower-band signal above the estimated bandwidth and the energy or the amplitude information of the lower-band signal above the estimated bandwidth.

18. The apparatus according to claim 17, wherein the first control sub-unit is configured to use energy or amplitude information of the decoded whole-band signal above the estimated bandwidth as the energy or the amplitude information of the lower-band signal above the estimated bandwidth; or use preset energy or amplitude information as the energy or the amplitude information of the lower-band signal above the estimated bandwidth, wherein the preset energy or amplitude is smaller than the energy or the amplitude of the energy or the amplitude information of the lower-band signal below the estimated bandwidth; or attenuate the energy or the amplitude information of the lower-band signal below the estimated bandwidth as the energy or the amplitude information of the lower-band signal above the estimated bandwidth.

* * * * *